US006126054A

United States Patent [19]

Riemer

[11] Patent Number: 6,126,054

[45] Date of Patent: Oct. 3, 2000

[54] DOUBLE OPENING BAG

[76] Inventor: Paul Riemer, 7642 Works Progress St., Siren, Wis. 54872

[21] Appl. No.: 09/261,762

[22] Filed: Mar. 3, 1999

[51] Int. Cl.[7] ..... A45F 3/02; B65D 33/28

[52] U.S. Cl. ..... 224/601; 224/607; 224/614; 383/25; 383/38; 383/41; 383/75

[58] Field of Search ..... 224/601, 607, 224/614, 917, 257, 258; 383/41, 25, 75, 74, 38; 206/579

[56] References Cited

U.S. PATENT DOCUMENTS 2,497,325 2/1950 Scherba ..... 383/41
2,552,443 5/1951 Molinari ..... 224/601
3,838,758 10/1974 Brown ..... 383/38
5,139,187 8/1992 Fowler ..... 224/917

*Primary Examiner*—Linda J. Sholl
*Attorney, Agent, or Firm*—Donald Cayen

[57] ABSTRACT

A double opening bag utilizes a single draw cord for closing both ends. The draw cord passes around the periphery of a tubular section of the bag adjacent the two ends. The draw cord extends closely alongside the tubular section when the openings are open. Pulling the draw cord closes both ends and creates slack in the draw cord. The slack is sufficient to serve as a shoulder strap for carrying the bag over a person's shoulder. A partition may be added to the interior of the bag generally between the ends to create two open-ended compartments that close simultaneously with the tubular section ends when the draw cord is pulled.

8 Claims, 2 Drawing Sheets

DOUBLE OPENING BAG

BACKGROUND OF THE INVENTION

1. Field of the Invention

This invention pertains to carrying apparatus, and more particularly to bags that close by means of a draw cord.

2. Description of the Prior Art

Flexible bags for carrying small items are well known and in widespread use. A common type of carrying bag has a closed end and an open end that is closable by means of a draw string. Typical examples of such bags may be seen in U.S. Pat. Nos. 3,599,690 and 4,815,640. U.S. Pat. No. 1,111,937 shows a sack for carrying fruit with an open end that is closable by a draw string.

U.S. Pat. No. 4,674,664 describes a small backsack with an open top. A draw string for the open top is long enough to pass over the wearer's shoulders and around his waist. U.S. Pat. No. 2,552,443 shows a shoulder bag having an open end and a closed end. A draw string for the open end is connected to the bag closed end. The draw string is long enough to be worn over the user's shoulder.

It is known to design carrying bags that are open at opposite ends. Examples of double opening bags may be seen in U.S. Pat. Nos. 1,748,087; 2,497,325; and 5,427,453. Separate draw strings are used for the two ends of the bags of the U.S. Pat. Nos. 1,748,087 and 2,497,325. To close the bag of the U.S. Pat. No. 5,427,453, built-in loops are passed through several circumferentially spaced grommets at the bag ends. A shoulder strap can be attached to the grommets at the bag ends.

Despite the wide variety of carrying bags presently available, there nevertheless is room for further development to them. Specifically, it is highly desirable that a bag be developed for carrying such bulky items as sleeping bags.

SUMMARY OF THE INVENTION

In accordance with the present invention, a versatile double opening carrying bag is provided that is more convenient to use then prior bags. This is accomplished by using an endless draw cord to close both ends of the bag.

The double opening bag may be of any practical size, length, and transverse shape. The bag has a tubular section with open ends. A casing with opposed small openings is formed around the tubular section periphery at each end. One end of a single long cord is passed through the casing at one end of the tubular section. The cord end then is also passed through the casing at the other end of the tubular section. The cord end is joined to the other end of the cord, which had remained outside of the tubular section. Accordingly, the bag has one endless cord.

The cord acts as a double draw cord. If desired, the draw cord can be manually pulled to close one end of the tubular section without closing the other end. However, it is contemplated that the draw cord will be used primarily to close both tubular section ends using the single draw cord. When the ends are closed, there is sufficient slack in the draw cord to enable it to function as a shoulder strap. In that manner, a person can carry the bag and its contents over his shoulder.

The interior of the tubular section may be divided into two or more compartments by longitudinally extending partitions. The partitions and compartments extend for substantially the full length of the tubular section. Pulling the draw cord to close the tubular section inherently and simultaneously closes the compartments.

The method and apparatus of the invention, using a single draw cord for closing both ends of the tubular carrying bag, thus enables a variety of items to be packed and carried with ease. The bag is exceptionally versatile and economical, because the cord functions both as a draw cord for the bag ends and as a carrying strap.

Other advantages, benefits, and features of the present invention will become apparent to those skilled in the art upon reading the detailed description of the invention.

DETAILED DESCRIPTION OF THE PREFERRED EMBODIMENT

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
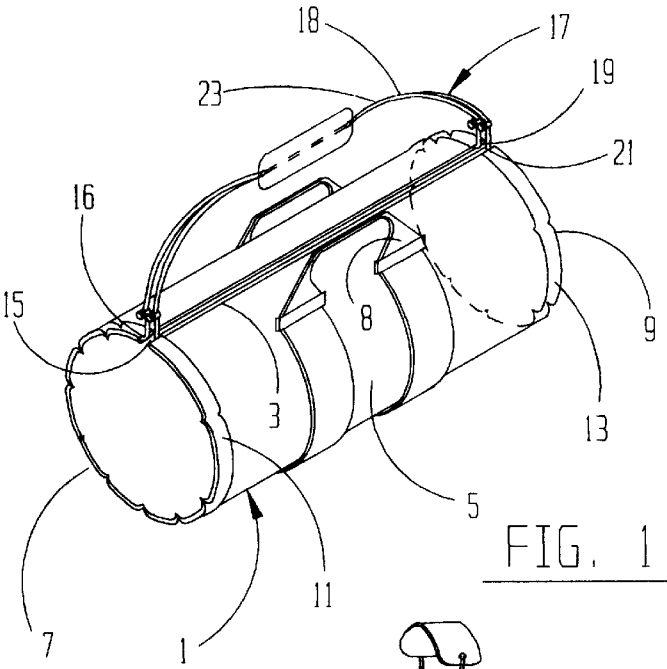
FIG. 1 is a perspective view of the carrying bag of the invention with both ends open.

Referring to FIG. 1, a double opening bag 1 is illustrated and includes the present invention. The double opening bag 1 is particularly useful for carrying bulky items such as sleeping bags. However, it will be understood that the invention is not limited to outdoor related applications.

In the illustrated construction, the double opening bag 1 is made from a rectangular blank of flexible material. Opposed edges of the blank are brought together and sewn along a longitudinal stitch line 3. The bag thus acquires a tubular section 5 with opposite ends 7 and 9. If desired, handles 8 can be sewn into the tubular section 5. Sewn around the periphery of the tubular section 5 at both ends 7 and 9 are respective casings 11 and 13. There are openings 15, 16 and 19, 21 in each casing 11 and 13, respectively.

Figure 4:
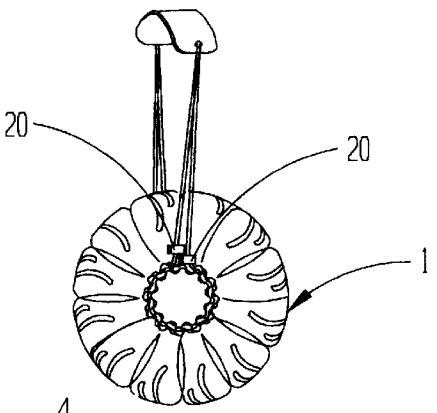
FIG. 4 is an end view of FIG. 3.
Figure 2:
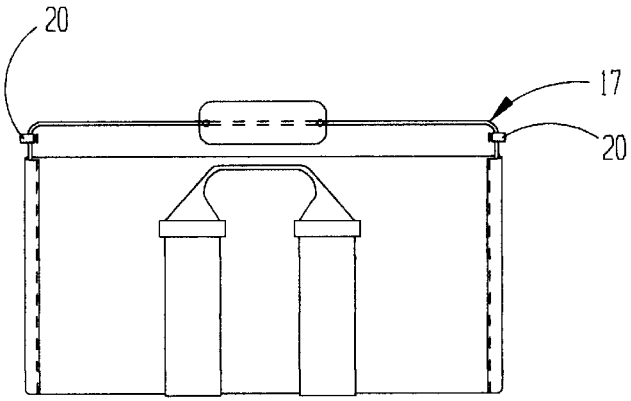
FIG. 2 is a front view of the carrying bag with both ends open.
Figure 3:
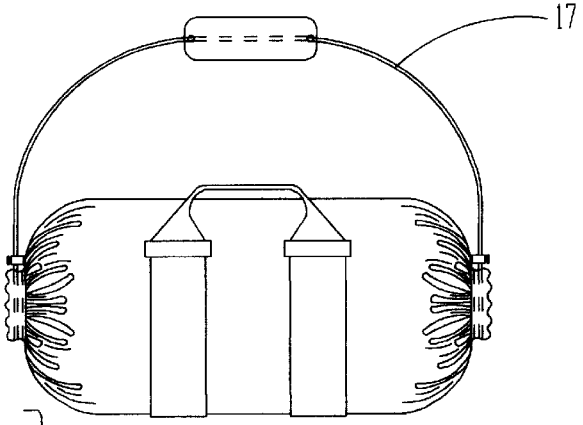
FIG. 3 is a front view of the carrying bag with both ends closed.

The casings 11 and 13 serve as passages for a long cord 17. One end 18 of the cord 17 is inserted into the opening 15 of the casing 11, worked through the entire casing, and pulled out the opening 16. Then the cord end 18 is pulled along the length of the tubular section 5 and inserted through the opening 19 in the casing 13. The cord end is worked through the casing 13 and pulled out the casing opening 21. The cord end 18 is then attached to the cord second end 23 such that the cord becomes endless, as shown in FIGS. 2–4. Spring loaded locking devices 20 may be used on the cord 17 at each end of the bag 1.

Figure 5:
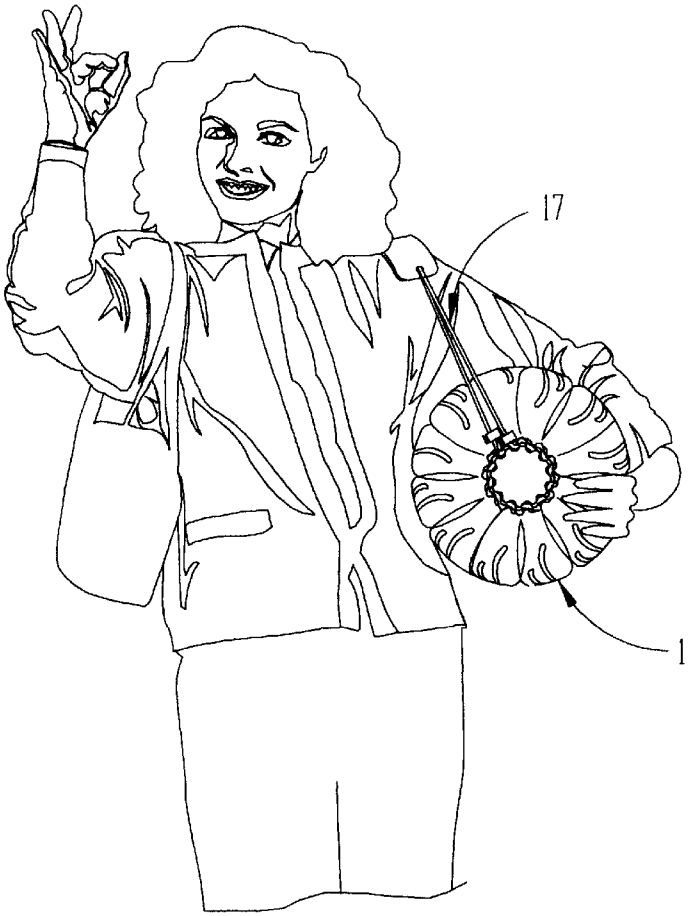
FIG. 5 is a view showing a person carrying the bag of the invention.

When the carrying bag ends 7 and 9 are open, FIGS. 1 and 2, the cord 17 lies close alongside the tubular section 5. The carrying bag 1 is closed at one or both ends by manually pulling the draw cord at the desired ends, FIGS. 3 and 4. When the ends are closed, the draw cord acquires a substantial amount of slack. The slack draw cord functions as a shoulder strap for conveniently carrying the bag, FIG. 5. The weight of the items carried in the bag produce sufficient tension on the draw cord to keep the bag ends closed without further attention. That is, continued or repeated manual pulling on the draw cord is not necessary to keep the bag closed.

An exemplary double opening bag according to the invention is designed to hold a sleeping bag. The double opening bag has a diameter of approximately 25 inches and a length of approximately 24 inches for the tubular section. The draw cord is approximately 148 inches long. The double opening bag enables the unwieldy sleeping bag to be as easy to handle as a piece of luggage carried over the shoulder.

Figure 6:
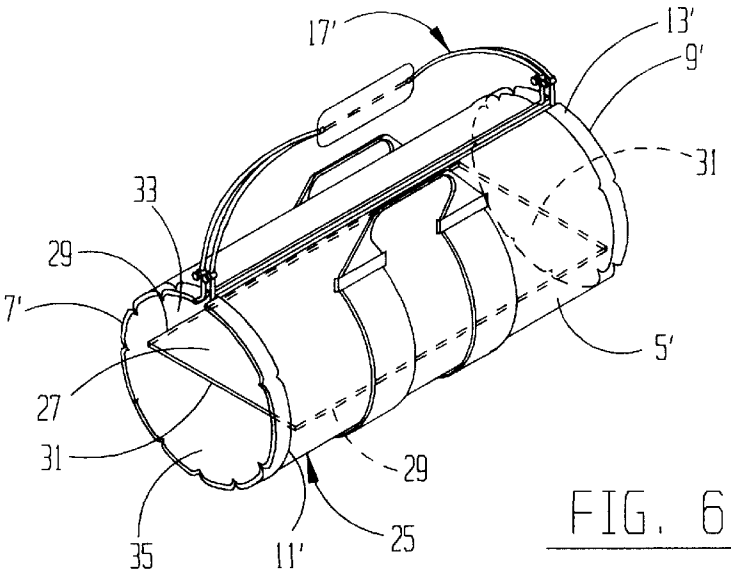
FIG. 6 is a view similar to FIG. 1, but showing a modified embodiment of the invention.

In a modified embodiment of the invention, a partition is incorporated into the carrying bag. In FIG. 6, a double opening bag 25 has a tubular section 5' and a single draw cord 17'. A rectangular partition 27 of flexible material is sewn along two longitudinal edges 29 to the interior of the tubular section 5'. The ends 31 of the partition 27 do not reach to the ends 7' and 9' of the tubular section. Rather, the partition ends 31 terminate slightly inwardly from the casings 11' and 13'. The result is that the tubular section is divided into two compartments 33 and 35. Both the compartments 33 and 35 are open at both ends of the carrying bag 25. It will be appreciated, of course, that the compartments 33 and 35 need not be of equal size, i.e., the partition need not be located at the diameter of the tubular section 5'. When the draw cord 17' is manually pulled, the ends 7' and 9' of the double opening bag close and inherently close the compartment ends.

Figure 7:
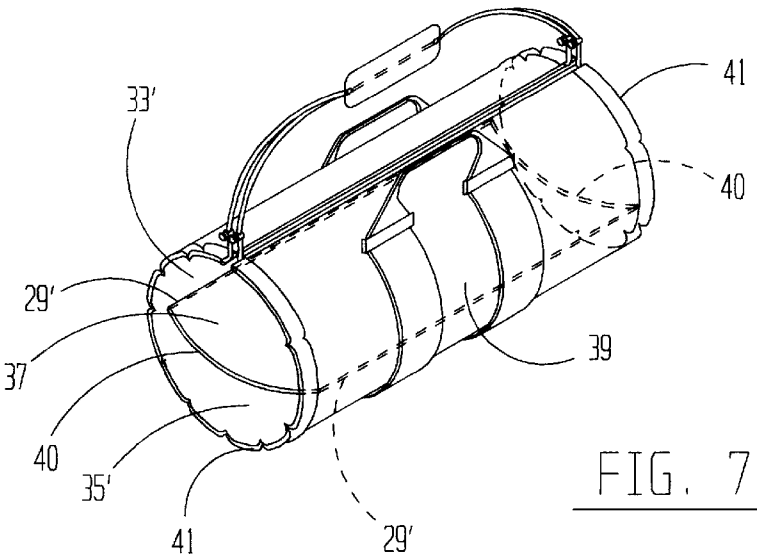
FIG. 7 is a view similar to FIG. 6, but showing a further modified embodiment of the invention.

In FIG. 7, a partition 37 has a width greater than the distance between the lines along which the partition edges 29' are sewn to the tubular section 39. Consequently, the areas of the compartments 33' and 35' can be varied. The ends 40 of the partition 37 do not extend to the ends 41 of the bag tubular section 39.

In summary, the ability to carry bulky and cumbersome items is now enhanced. This desirable result comes from using the combined functions of the single draw cord. The draw cord closes the open ends of the double opening bag either simultaneously or one at a time. The draw cord also serves as a shoulder strap when the bag ends are closed. It will also be recognized that in addition to the superior performance of the double opening bag, its construction is such as to cost no more than traditional carrying bags.

Thus, it is apparent that there has been provided, in accordance with the invention, a double opening bag that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A double opening bag for carrying selected items comprising:

a. a flexible tubular section having a periphery and first and second open ends, the tubular section periphery having a casing therearound at each of the first and second ends, each casing having opposed openings therein; and b. an endless draw cord extending along the tubular section between the ends and passing through the casings, the draw cord being selectively pullable to close one or both ends, the draw cord being close alongside the tubular section when the tubular section ends are open and the draw cord having substantial slack when the draw cord is pulled to close the tubular section ends, the draw cord slack enabling the double opening bag and the items therein to be carried over the shoulder of a person.

2. Apparatus that enables a bulky sleeping bag to be carried over a person's shoulder comprising a flexible bag of a type having a tubular section that defines a periphery, an interior, and opposed open ends that enable the sleeping bag to be inserted into the flexible bag interior, the flexible bag having a casing around the periphery proximate each end, and an endless draw cord that passes through and between the casings, the draw cord having sufficient slack when the tubular section ends are closed to serve as a shoulder strap for carrying the sleeping bag over the person's shoulder.

3. The apparatus of claim 2 wherein the draw cord lies closely alongside the tubular section when the ends thereof are open.

4. The apparatus of claim 2 further comprising a partition having opposed edges fastened to opposite sides of the tubular section in the interior thereof to thereby divide the flexible bag interior into compartments, the partition further having opposed ends that are spaced a predetermined distance from the associated ends of the bag tubular section, the compartments having respective opposed open ends that terminate inwardly of the associated tubular section open ends, the compartment open ends closing simultaneously with the closing of the associated tubular section open ends.

5. The apparatus of claim 4 wherein the compartments are of unequal cross sectional area.

6. A method of carrying a selected item comprising the steps of:

a. providing a flexible bag having a tubular section with a periphery and opposed open ends;

b. passing an endless draw cord around the tubular section periphery proximate each open end thereof and extending the draw cord alongside the tubular section between the opposed ends thereof;

c. inserting the item into the bag through a selected tubular section open end;

d. manually pulling the draw cord to close both ends of the tubular section and simultaneously creating a slack in the draw cord; and e. placing the slack draw cord over a shoulder and thereby carrying the item over the shoulder.

7. The method of claim 6 wherein:

a. the step of providing a bag comprises the step of providing a bag with at least two compartments each extending generally between the tubular section ends; and b. the step of pulling the draw cord comprises the step of closing the compartment ends simultaneously with closing the tubular section ends.

8. An improved bag for carrying over a person's shoulder comprising a flexible tubular section having opposed open ends through which selected items can be placed into the tubular section, a casing at each end of the tubular section adjacent the associated open end, and a single endless draw cord passing through the casings and extending alongside the tubular section between the casings, the draw cord closing both tubular section ends and acquiring sufficient slack when manually pulled to enable the draw cord to be slung over the shoulder of the person, the weight of the items in the tubular section producing sufficient tension in the draw cord to maintain both tubular section ends closed without continued or additional manual pulling on the draw cord.

* * * * *